US006627250B1

(12) United States Patent
Flohr et al.

(10) Patent No.: US 6,627,250 B1
(45) Date of Patent: Sep. 30, 2003

(54) METHOD OF SAFEGUARDING ELECTRICAL SWITCHGEAR, IN PARTICULAR, AGAINST IMITATION

(75) Inventors: Peter Flohr, Mainz (DE); Karl Thomas Werner, Wiesental (DE)

(73) Assignee: ABB Patent GmbH, Ladenburg (DE)

( * ) Notice: Subject to any disclaimer, the term of this patent is extended or adjusted under 35 U.S.C. 154(b) by 0 days.

(21) Appl. No.: 09/591,332

(22) Filed: Jun. 9, 2000

(30) Foreign Application Priority Data

Jun. 9, 1999 (DE) ..... 199 26 166

(51) Int. Cl.[7] ..... B41M 3/14

(52) U.S. Cl. ..... 427/7; 427/160; 427/256; 427/595; 264/410; 264/492

(58) Field of Search ..... 427/7, 595, 160, 427/256; 264/410, 492

(56) References Cited

U.S. PATENT DOCUMENTS 4,744,328 A * 5/1988 Stevens et al. ..... 427/7
5,093,147 A * 3/1992 Andrus et al. ..... 346/98
5,300,764 A * 4/1994 Hoshino et al. ..... 235/487
5,401,561 A * 3/1995 Fisun et al. ..... 428/195
5,599,578 A * 2/1997 Butland ..... 427/7
5,605,738 A * 2/1997 McGinness et al. ..... 427/7
6,200,628 B1 * 3/2001 Rozumek et al. ..... 427/7
6,479,133 B1 * 11/2002 Kaule et al. ..... 428/195

* cited by examiner

*Primary Examiner*—Shrive P. Beck
*Assistant Examiner*—Kirsten Crockford Jolley
(74) *Attorney, Agent, or Firm*—Laurence A. Greenberg; Werner H. Stemer; Gregory L. Mayback

(57) ABSTRACT

A method for marking a product for detecting unauthorized imitations of the product, in particular of electrical switchgear equipment and the like. A color imprint is applied to an outer or inner surface of a housing of the switchgear or the like. The color imprint contains pigments that can be detected only by special methods, for example infrared examination and the like.

3 Claims, No Drawings

METHOD OF SAFEGUARDING ELECTRICAL SWITCHGEAR, IN PARTICULAR, AGAINST IMITATION

BACKGROUND OF THE INVENTION

Field of the Invention

The invention relates to a method for modifying a product to detect unauthorized imitations of the product.

At the present time it is possible to see well counterfeited electrical switchgear being pushed onto the European market more and more frequently from in particular so-called low wage countries. Many of these counterfeits are so good that they can easily be confused with original switchgear. If, as a result of the counterfeited switchgear, damage is caused because of a fault, for example a non-response in the case of an overcurrent or in the case of a short circuit, or if, for example, a person is killed because a residual-current circuit-breaker does not trigger, there is the problem that the original manufacturer cannot prove that the relevant device was not produced at its production facilities. Under certain circumstances considerable claims for compensation can be made against the manufacturer.

It has been proposed to identify such electrical switchgear by a sticker made of security paper. However, in the case of a fire there is the risk that a security sticker of this type will be destroyed; in addition, it needs some space, in particular if it is stuck to the broadside.

SUMMARY OF THE INVENTION

It is accordingly an object of the invention to provide a method of safeguarding electrical switchgear, in particular, against imitations that overcomes the above mentioned disadvantages of the prior art methods of this general type, in which electrical switchgear is identified in such a way that it easy to detect counterfeits.

With the foregoing and other objects in view there is provided, in accordance with the invention, a method for marking an item to detect unauthorized imitations of the item, which includes applying a color imprint to a device, the color imprint containing pigments that can be detected only by special methods and apparatus.

In accordance with an added feature of the invention, there is the step of applying the color imprint to one of an outer surface and an inner surface of a housing of the device.

In accordance with an additional feature of the invention, there is the step of applying the color imprint to electrical switchgear equipment.

In accordance with another feature of the invention, there is the step of detecting the pigments in the color imprint by infrared examination.

With the foregoing and other objects in view there is further provided, in accordance with the invention, a method for marking an item to detect unauthorized imitations of the item, which includes mixing pigments that can be detected only by special methods and apparatus in with material forming a manually operated pivoting lever used in line-protection circuit-breakers and residual-current circuit-breakers.

With the foregoing and other objects in view there is also provided, in accordance with the invention, a method for marking an item to detect unauthorized imitations of the item, which includes imprinting a housing of a residual-current circuit-breaker having a residual-current release with an ink containing pigments that can be detected by special methods and devices.

With the foregoing and other objects in view there is additionally provided, in accordance with the invention, a method for marking packaging used for packing electrical switchgear for assisting in detecting counterfeits, which includes applying a seal at bonding points of walls forming the packaging, the seal having been imprinted with an ink containing pigments that can be detected only by special methods and devices.

Other features which are considered as characteristic for the invention are set forth in the appended claims.

Although the invention is described herein as embodied in a method of safeguarding electrical switchgear, in particular, against imitations, it is nevertheless not intended to be limited to the details described, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments.

DESCRIPTION OF THE PREFERRED EMBODIMENT

According to the invention, specific points on an item of switchgear are imprinted with ink that cannot be destroyed in a fire.

For this purpose, use is made of a specific pigmentation which is protected under the trademark GD APT (Anti-Piracy Technology) from the company Gieseke & Devrient, Munich, Germany.

Some items of switchgear have a specific color imprint, which is used as proof of origin for the manufacturer. For example, the imprint can be a strip colored with a specific ink, or the company logo and the like; the pigment or the pigments can then be mixed in with the ink for these imprints.

It is also possible to incorporate the relevant pigmentation into such components of the device as are used in all the switchgear from the relevant manufacturer. Thus, for example, the switch knob for an item of electrical switchgear is suitable for this purpose, since the switch knob is used in an essentially identical way both in line-protection circuit-breakers and residual-current circuit-breakers or auxiliary switches. Therefore, according to the invention, the pigments are mixed into the switch knob, so that these pigments can be detected with specific detection methods and devices, even when the item of switchgear has been destroyed, for example by fire.

In the case of residual-current circuit-breakers, the release is often also counterfeited; it goes without saying that the aforementioned pigments can be mixed either into the housing of the release or in an imprint on the release. This achieves the situation where the residual-current release can also be detected as having been produced by the manufacturer.

Electrical switchgear, and incidentally other devices as well, are for the most part inserted into a package, which generally consists of cardboard and in which specific wall sections are stuck to one another. It is easily possible to open these adhesive bonds of the packaging using fine tools, to pack the counterfeits into the packaging and to close it again. In order to safeguard against this, it is expedient, at the bonding points of the packaging, to stick on seals that are provided with an imprint that likewise again contains the above-mentioned pigments.

The invention has been described with reference to switchgear; of course, it can also be used in all other products that can be counterfeited, for example spare parts for motor vehicles, aircraft or the like.

We claim:

1. A method-for marking one of an electric line-protection circuit-breaker, an electric engine-protection circuit-breaker and an electric residual-current circuit-breaker to detect unauthorized imitations of the circuit-breaker, the method comprises:

mixing a pigment into a component of the circuit-breaker, the pigment being an indestructible, invisible authenticating mark that can be detected only by an infrared detecting method and apparatus.

2. The method according to claim 1, which comprises:

providing a housing for the circuit-breaker; and applying the pigment to one of an outer surface and an inner surface of the housing.

3. The method according to claim 1, which comprises:

providing a packaging for the circuit breaker; and applying a seal at bonding points of walls forming the packaging, the seal having been imprinted with an ink containing an invisible authenticating mark that can be detected only by an infrared detecting method and device.

* * * * *